United States Patent [19]

Nakashio et al.

[11] 3,932,192

[45] Jan. 13, 1976

[54] PAPER COATING MATERIAL CONTAINING PULLULAN

[75] Inventors: Seizo Nakashio, Nishinomiya; Noriyuki Sekine, Toyonaka; Nobuhiro Toyota, Ibaragi; Fumio Fujita, Osaka; Masahiro Domoto, Toyonaka, all of Japan

[73] Assignees: Sumitomo Chemical Company, Limited, Osaka; Hayashibara Biochemical Laboratories, Inc., both of Japan

[22] Filed: Sept. 24, 1974

[21] Appl. No.: 508,731

[30] Foreign Application Priority Data

Sept. 29, 1973 Japan ..... 48-109943

[52] U.S. Cl. ..... 106/204; 106/213; 260/9

[51] Int. Cl.[2] ..... C08C 5/00

[58] Field of Search ..... 106/204, 213, 214

[56] References Cited

UNITED STATES PATENTS 3,784,390 1/1974 Hijiya et al. ..... 106/213

*Primary Examiner*—Theodore Morris

*Attorney, Agent, or Firm*—Stevens, Davis, Miller & Mosher

[57] ABSTRACT

A coating material obtained by incorporating into a paper coating material pullulan, which is a linear high polymer having repetition units, bonded through $\alpha$-1,6 linkages, of maltotriose, a trimer of glucose, and is represented by the formula,

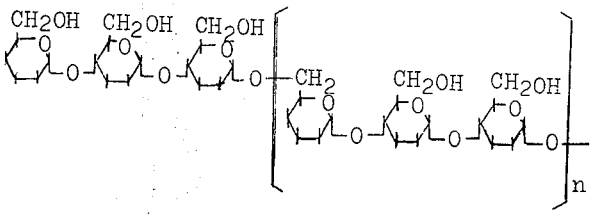

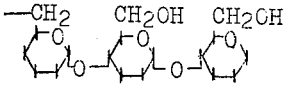

wherein n represents the polymerization degree and is an integer of 20 to 10,000, is excellent in such properties as gloss, printing gloss, adhesive strength, and viscosity stability during storage.

3 Claims, No Drawings

PAPER COATING MATERIAL CONTAINING PULLULAN

This invention relates to a paper-coating material containing pullulan. More particularly, the invention pertains to a novel paper-coating material containing pullulan which is excellent in gloss, printing gloss, adhesive strength, and viscosity stability during storage.

A high-grade printing paper such as art paper or coated paper is ordinarily prepared by coating on a base paper a paper-coating material composed mainly of a pigment such as clay or titanium dioxide and an adhesive. The adhesive used in this case includes various substances, and typical examples thereof are natural high polymers such as casein and starch, and synthetic emulsion latexes such as styrene-butadiene latexes.

Casein is an excellent adhesive, but has such disadvantages that it greatly fluctuates in cost and is expensive, and requires alkali when desired to be dissolved. Starch is frequently used in the form of a processed starch such as oxidized or etherized starch and is characteristically inexpensive, but has such disadvantages that it requires heating at the time of dissolution, inferior in viscosity stability during storage, and forms a coating low in water resistance and insufficient in flexibility.

As the synthetic emulsion latexes, there are chiefly used styrene-butadiene emulsion latexes and, in some cases, methyl methacrylate-butadiene emulsion latexes or vinyl acetate emulsion latexes, but these have such disadvantages that they are low in water retainability, insufficient in rigidity, excessively low in viscosity, and liable to be colored.

An object of the present invention is to provide a paper-coating material containing pullulan.

Another object of the invention is to provide a novel paper-coating material excellent in gloss, printing gloss, adhesive strength, and viscosity stability during storage.

Other objects and advantages of the invention will become apparent from the explanation given below.

The present inventors have found that pullulan is high in adhesive power and has excellent properties as a paper-coating adhesive. The pullulan has many such characteristics as being excellent in gloss, printing gloss, adhesive strength, and viscosity stability during storage. Furthermore, it is easily soluble in cold water and hence is markedly advantageous also from the stand-point of processing.

The pullulan used in the present invention is a linear high polymer having repetition units, bonded through $\alpha$-1,6-linkages, of maltotriose, a trimer of glucose, and has a molecular structure represented by the formula,

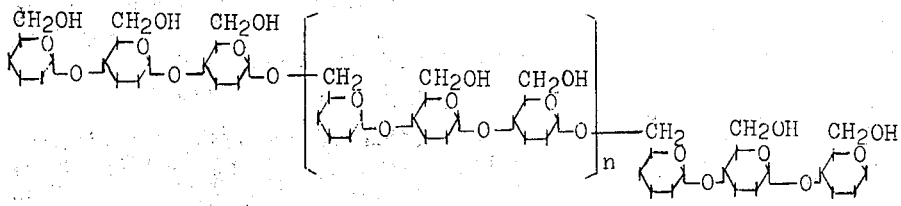

wherein n represents the polymerization degree and is an integer of 20 to 10,000.

The pullulan has been known merely as a water-soluble tacky substance, and the physical properties and uses thereof have not been studied extensively hitherto. In this sense, the pullulan is equal to an unknown compound, in practice. The present inventors studied the pullulan with keen interest to find that it has excellent properties as an adhesive for paper-coating materials. Based on this finding, the inventors have accomplished the present invention.

Although it contains glucose units in the molecule, the pullulan used in the present invention is entirely different in molecular structure from starch, oxidized starch, etherized starch, cationized starch, alkyl cellulose and gum arabic which also are derivatives having glucose units and have heretofore been used as paper-coating materials. Further, the pullulan is greatly different in properties from said paper-coating materials. For example, it is easily soluble in cold water, and its aqueous solution is stable over a long period of time and brings about no gelation nor so-called "aging" phenomenon. This is a characteristic which is markedly different from the properties of starch and its derivatives.

An example of procedure for producing the pullulan is illustrated below.

The pullulan is a linear compound that is different in molecular structure from other polysaccharides such as starch, and can be synthesized by the process using an enzyme (e.g. U.S. Pat. No. 3,827,937). At the present, it can be obtained as a tacky substance secreted in a culture liquor of a strain belonging to the genus Pullularia which is an incomplete microorganism [H. Bender, J. Lehmann et al.: Biochem. Biophys. Acta, 36, 309 (1959); Seinosuke Ueda: Kogyo Kagaku Zasshi (Journal of Industrial Chemistry), 67, 757 (1964)]. That is, a strain Pullularia pullulan is subjected to shaking culture at 24°C. for 5 days in a medium containing 10% of partially hydrolyzed starch, 0.5% of $K_2HPO_4$, 0.1% of NaCl, 0.02% of $MgSO_4 \cdot 7H_2O$, 0.06% of $(NH_4)_2SO_4$ and 0.04% of yeast extract, whereby a tacky substance is secreted from the cells into the culture liquor. The culture liquor is freed from the cells by centrifugation, and the supernatant is charged with methanol to deposit a pullulan precipitate. After repeating water dissolution and methanol precipitation, white pullulan is recovered, washed with methanol and dried, whereby dry pullulan is obtained in a yield of 60 to 70% based on the saccharide.

The molecular weight of the pullulan used in the present invention is not particularly limited, but is preferably from 10,000 to 5,000,000, more preferably 50,000 to 1,000,000.

In the paper-coating material of the present invention, the pullulan can be used singly as paper-coating material in view of its excellent adhesive power and film-forming property, but may preferably used in admixture with other adhesive.

In using resins for a certain purpose, it is an ordinary practice, in general, to use the resins in admixture with each other in order to cover up the defects and enhance the effects of the individual resins. In the case of paper-coating materials also, the combination use is most general, and is preferable in the present invention as well. For example, oxidized starches, which have such defects as being high in rigidity and low in water resistance, are frequently used in combination with styrene-butadiene latexes in order to cover up the said defects.

Examples of adhesives, which may effectively be used in combination with the pullulan, include synthetic latexes such as styrene-butadiene latexes, methyl methacrylate-butadiene latexes, vinyl acetate latexes, ethylene-vinyl acetate latexes, acrylic acid-butadiene latexes, acrylic ester copolymer latexes, vinyl acetate-acrylic ester copolymer latexes, styrene-acrylic ester latexes and butadiene-acrylonitrile latexes, casein, glue, gelatin, starch, processed starches such as oxidized starch, etherized starch, and cationized starch, and polyvinyl alcohols and modification products thereof.

Further, there may be adopted any known procedure to insolubilize polymers having active hydrogen or hydroxyl groups, or there may be used in combination a reactive resin or reagent which itself is chemically crosslinkable by thermal or photochemical reaction. Concrete examples of said reactive resin are melamine, phenol, resorcinol, urea, alkyd, aminoalkyd, polyurethane, epoxy, acryl, unsaturated polyester, glyoxal and polyamide resins, and various reagents containing epoxy, methylol, isocyanate, amino, carboxyl or aldehyde groups.

The pigment to be used in the paper-coating material of the present invention may be any of conventional pigments such as clay, calcium carbonate, titanium dioxide, satin white and aluminum hydroxide.

In addition thereto, the paper-coating material of the present invention may be incorporated with one or more of such adjuncts as a pigment dispersant, e.g. sodiumhexametaphosphate, sodium pyrophosphate, or low molecular weight sodium polyacrylate, a viscosity regulator, e.g. urea or dicyandiamide, a lubricant, e.g. calcium stearate, calcium palmitate or wax emulsion, a defoaming agent, e.g. higher fatty acid, higher alcohol or silicon emulsion, a fluorescent brightener, or a colored dye.

The amount of the pullulan used in the paper-coating material of the present invention is optional, but is preferably in the range from 0.1 to 99% by weight based on the weight of the total solid content.

The paper-coating material of the present invention may be coated on a base paper by any known on- or off-machine-coating such as knife coating, air knife coating, blade coating, roll coating or size press coating. In case one side of the paper is to be subjected to two or more times' coating, by combination of blade coating and blade coating or blade coating and air knife coating, one or both coating may be conducted by use of the coating material of the present invention. Further, coating may be applied to one or both sides of a base paper.

The drying step after coating may also be carried out by use of a conventional dryer such as festoon dryer or high speed dryer. The drying temperature is not particularly limited, but is usually 50° – 130°C.

The coating material of the present invention can form a film capable of exhibiting an excellent gloss by calendering. Accordingly, a paper coated with the present coating material can provide a sufficient gloss even when finished by only supercalendering. In case a particularly excellent gloss is desired, however, there may be used an ultra-supercalendering machine such as printing machine or friction-calendering machine.

The present invention is illustrated in detail below with reference to Examples, but the invention is not limited to the Examples.

Various values shown in the examples were measured in the following manner:

1. "Viscosity" was measured at 27°C. by use of Viscometer, Model B, manufactured by Tokyo Keiki Co.
2. "Gloss" was a 75° specular gloss measured by use of Glossmeter, Model GH-3, manufactured by Murakami Shikisai Giken (JIS P-8142).

"Printing gloss" was determined by offset-printing the coated surface of a sample paper with a printing ink, Speed King Ace TV-15 (produced by Toyo Ink Co.), drying the printed paper, and then measuring the 75° specular gloss of the printed surface.

3. "Whiteness" was measured by use of a Hunter's reflectometer (JIS P-812).
4. "Ink absorptivity" was determined by applying a K & N Ink onto the coated surface of a sample paper, wiping the ink off after 2 minutes by means of a cloth, and then measuring the whiteness of the surface by use of a Hunter's reflectometer.
5. "RI dry picking" and "RI wet picking" were measured by use of an RI tester.

The RI dry picking was measured by use of a printing ink, Speed King ACE TV-15, and represented by the number of rotations required until the coated surface was peeled.

The RI wet picking was measured by use of a printing ink, Speed King ACE TV-12, and represented by the amount of ink transferred to the wet coated surface.

In the examples, "parts" are by weight unless otherwise specified.

EXAMPLE 1

A coating material was prepared by mixing together 100 parts of kaolin clay, 0.3 part of sodium hexametaphosphate, 15 parts of pullulan and 115 parts of water. The viscosity of this coating material immediately after preparation was 820 cps., while the viscosity thereof after 48 hours was 864 cps., and thus the coating material had a stability of 1.05 and was stable. (The "stability" referred to herein means the ratio between the viscosity of coating material immediately after preparation ($\eta_o$) and the viscosity thereof after lapse of a definite period of time ($\eta_t$) and represented by $\eta_t/\eta_o$, and the smaller the stability value, the more stable the coating material.)

This coating material was manually coated on a base paper (KYP, produced by Sanyo Kokusaku Pulp Co.) by use of Wire Rod No. 14, and then air-dried at 100°C. for 1 minute. Thereafter, the coated paper was subjected 2 times to supercalendering treatment at 60°C. under a pressure of 120 kg/cm. The gloss of the coated paper was 77.5% and thus was excellent.

COMPARATIVE EXAMPLE 1

A coating material was prepared by mixing together 100 parts of kaolin clay, 0.3 part of sodium hexametaphosphate, 15 parts of oxidized starch (S-sunsizer-500, produced by Ajinomoto Co.) and 115 parts of water. The viscosity of this coating material immediately after preparation was 783 cps., while the viscosity thereof after 48 hours was 1,090 cps., and thus the coating material had a stability of 1.39. Using this coating material, a coated paper was prepared in the same manner as in Example 1. The gloss of the coated paper was 60.2%.

Another coating material was prepared by mixing together 100 parts of kaolin clay, 0.3 part of sodium hexametaphosphate, 15 parts of milk casein and 172 parts of water. The viscosity of this coating material immediately after preparation was 1,960 cps., while the viscosity thereof after 48 hours was 3,230, and thus the coating material had a stability of 1.68. Using this coating material, a coated paper was prepared in the same manner as in Example 1. The gloss of the coated paper was 56.2%.

EXAMPLE 2

A coating material was prepared by mixing together 100 parts of kaolin clay (Ultrawhite 90), 0.3 part of sodium hexametaphosphate, 10 parts of pullulan, 8 parts of styrene-butadiene latex (Dowlatex 620) and 118 parts of water. The viscosities of this coating material immediately after preparation and after 24 hours were as shown in Table 1. The coating material had an excellent viscosity stability.

This coating material was manually coated on the wire side of a base paper (KYP, produced by Sanyo Kokusaku Pulp Co.) by use of Wire Rod No. 14, and then air-dried at 100°C. for 1 minute. Thereafter, the coated paper was subjected 2 times to supercalendering treatment at 60°C. under a pressure of 137 kg/cm. This coated paper was measured in coated amount, gloss, printing gloss, whiteness, ink absorptivity, RI dry picking and RI wet picking to obtain such results as shown in Table 2. From Table 2, it is understood that the paper coated with the coating material containing pullulan is excellent in every one of gloss, printing gloss, ink absorptivity, RI dry picking and RI wet picking.

COMPARATIVE EXAMPLE 2

Example 2 was repeated, except that the pullulan was replaced by oxidized starch (S-sunsizer-500).

The viscosities of the coating material were as shown in Table 1, and the coated amount, gloss, printing gloss, whiteness, ink absorptivity, RI dry picking and RI wet picking of the coated paper were as shown in Table 2.

Table 1

| | Viscosity stability | | |
|---|---|---|---|
| | Immediately after preparation | After 24 hours | Stability |
| Example 2 | 550 cps. | 556 cps. | 1.03 |
| Comparative Example 2 | 532 cps. | 650 cps. | 1.22 |

Table 2

| | | | Printability | | | | |
|---|---|---|---|---|---|---|---|
| | Coated amount (g/m²) | Gloss (%) | Printing gloss (%) | Whiteness | Ink absorptivity (whiteness %) | RI dry picking | RI wet picking |
| Example 2 | 20.4 | 73.7 | 89.8 | 81.4 | 50.4 | Fourth time | Excellent |
| Comparative Example 2 | 19.0 | 58.3 | 77.0 | 81.5 | 56.7 | Second time | Fair |

What is claimed is:

1. A paper-coating composition comprising pullulan and at least one pigment selected from the group consisting of clay, calcium carbonate, titanium dioxide, satin white and aluminum hydroxide.

2. A paper-coating composition according to claim 1, wherein the molecular weight of said pullulan is 10,000 to 5,000,000.

3. A paper-coating composition according to claim 1, wherein the amount of said pullulan is 0.1 to 99% by weight based on the total solid content of the coating composition.

* * * * *